US011371309B2

(12) United States Patent
Arteaga

(10) Patent No.: US 11,371,309 B2
(45) Date of Patent: Jun. 28, 2022

(54) BLOWOUT PREVENTER WITH A THREADED RAM

(71) Applicant: Cameron International Corporation, Houston, TX (US)

(72) Inventor: Nicolas Arteaga, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/243,061

(22) Filed: Jan. 8, 2019

(65) Prior Publication Data

US 2020/0217166 A1 Jul. 9, 2020

(51) Int. Cl.
*E21B 33/06* (2006.01)

(52) U.S. Cl.
CPC ..... *E21B 33/062* (2013.01)

(58) Field of Classification Search
USPC ..... 251/1.1, 1.2, 1.3
See application file for complete search history.

(56) References Cited

U.S. PATENT DOCUMENTS

| | | | | |
|---|---|---|---|---|
| 1,569,247 A | | 1/1926 | Abercrombie | |
| 1,834,921 A | * | 12/1931 | Abercrombie | E21B 33/062 251/1.3 |
| 1,875,673 A | * | 9/1932 | Stockstill | E21B 29/08 166/95.1 |
| 2,162,018 A | * | 6/1939 | Inge | E21B 33/06 251/1.3 |
| 2,163,178 A | | 6/1939 | Otis | |
| 2,237,709 A | * | 4/1941 | Lowe | E21B 33/062 277/325 |
| 2,320,974 A | * | 6/1943 | Macclatchie | E21B 33/062 251/1.1 |
| 2,749,078 A | * | 6/1956 | Losey | E21B 33/062 277/325 |
| 2,934,148 A | * | 4/1960 | Allaire | E21B 33/047 166/97.5 |
| 3,739,845 A | | 6/1973 | Berry et al. | |
| 3,744,749 A | * | 7/1973 | Le Rouax | E21B 33/062 251/1.3 |
| 4,574,881 A | | 3/1986 | Bednarz | |
| 5,735,502 A | | 4/1998 | Levett et al. | |
| 6,719,262 B2 | | 4/2004 | Whitby et al. | |
| 7,300,033 B1 | | 11/2007 | Whitby et al. | |
| 7,338,027 B1 | | 3/2008 | Whitby et al. | |
| 7,374,146 B2 | | 5/2008 | Whitby et al. | |
| 8,851,451 B2 | | 10/2014 | Orino et al. | |

(Continued)

FOREIGN PATENT DOCUMENTS

| | | |
|---|---|---|
| CN | 1020301 A | 7/1990 |
| EP | 2884139 A1 | 6/2015 |

OTHER PUBLICATIONS

U.S. Appl. No. 15/827,170 entitled "Blowout Preventers with Pressure-Balanced Operating Shafts", filed on Nov. 30, 2017.

(Continued)

*Primary Examiner* — Daphne M Barry
(74) *Attorney, Agent, or Firm* — Kelly McKinney

(57) ABSTRACT

An assembly for a blowout preventer includes a ram having a threaded opening. The assembly also includes a threaded shaft to engage the threaded opening and a motor to drive rotation of the threaded shaft. Rotation of the threaded shaft causes the ram to move axially along the threaded shaft.

18 Claims, 6 Drawing Sheets

(56) References Cited

U.S. PATENT DOCUMENTS

| | | | | |
|---|---|---|---|---|
| 9,970,569 | B2 | 5/2018 | Kotrla et al. | |
| 10,619,442 | B2 | 4/2020 | Arteaga | |
| 2002/0104662 | A1 | 8/2002 | Dallas | |
| 2003/0024705 | A1 | 2/2003 | Whitby et al. | |
| 2004/0031940 | A1 | 2/2004 | Biester | |
| 2008/0048139 | A1* | 2/2008 | Whitby | E21B 33/062 251/1.3 |
| 2008/0067458 | A1 | 3/2008 | Whitby et al. | |
| 2010/0319906 | A1 | 12/2010 | Van Winkle | |
| 2011/0140013 | A1 | 6/2011 | Guo et al. | |
| 2013/0126763 | A1 | 5/2013 | Guo et al. | |
| 2013/0313449 | A1 | 11/2013 | Weir et al. | |
| 2017/0130575 | A1 | 5/2017 | Jaffrey | |
| 2017/0362911 | A1 | 12/2017 | Read et al. | |
| 2018/0283126 | A1 | 10/2018 | Haverstad et al. | |
| 2018/0347710 | A1 | 12/2018 | Whitby | |

OTHER PUBLICATIONS

International Search Report and Written Opinion issued in International Patent application PCT/US2020/012314 dated Apr. 28, 2020, 12 pages.

International Preliminary Report on Patentability issued in International Patent application PCT/US2020/012314, dated Jul. 22, 2021, 9 pages.

* cited by examiner

BLOWOUT PREVENTER WITH A THREADED RAM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) is installed on a wellhead to seal and control an oil and gas well during various operations. For example, during drilling operations, a drill string may be suspended from a rig through the BOP into a wellbore. A drilling fluid is delivered through the drill string and returned up through an annulus between the drill string and a casing that lines the wellbore. In the event of a rapid invasion of formation fluid in the annulus, commonly known as a "kick," the BOP may be actuated to seal the annulus and to control fluid pressure in the wellbore, thereby protecting well equipment positioned above the BOP. The construction of the BOP can affect operation of the BOP.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
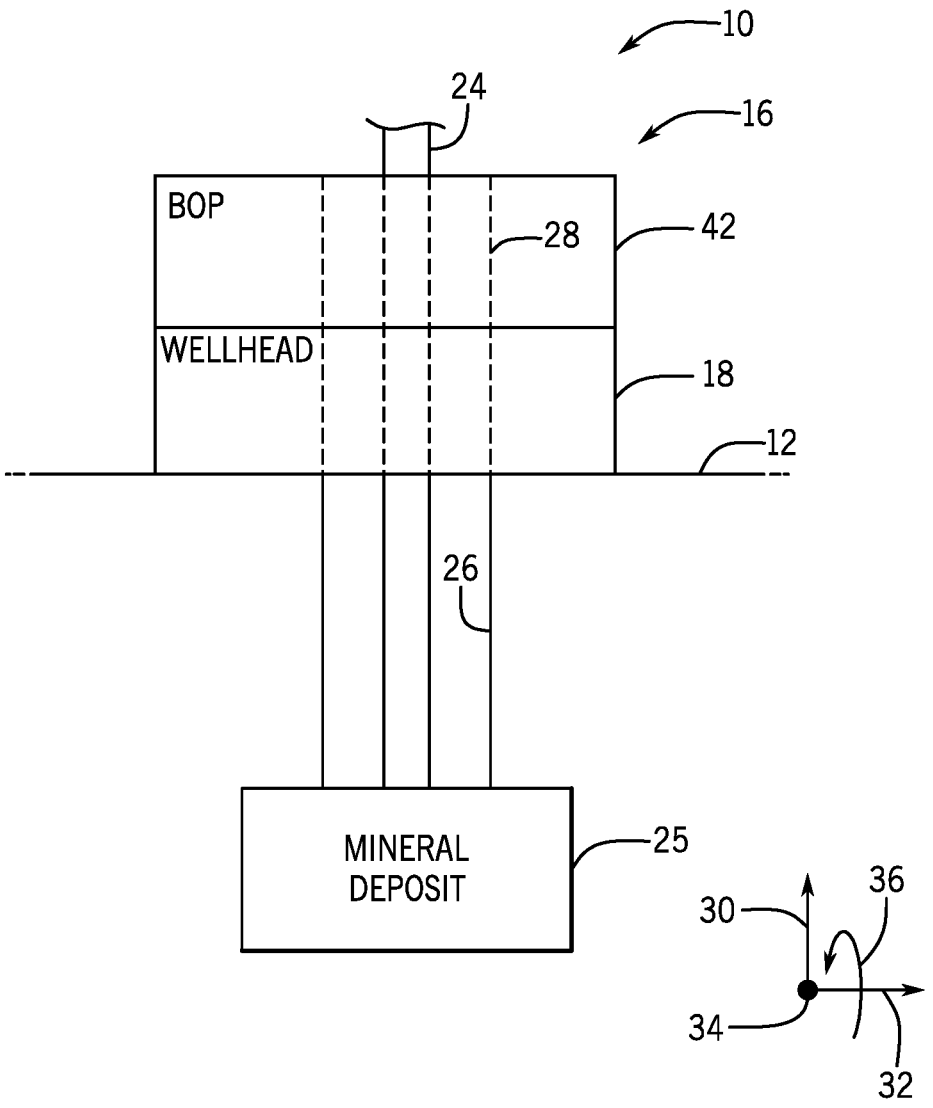
FIG. 1 is a block diagram of an embodiment of a mineral extraction system.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments generally relate to a blowout preventer (BOP) for a mineral extraction system. The BOP may include a first ram and a second ram that move toward and away from one another to adjust the BOP between an open position and a closed position. The first ram may include a first threaded opening to receive a first threaded shaft, and the second ram may include a second threaded opening to receive a second threaded shaft. The first threaded shaft may be coupled to and driven to rotate by a first motor (e.g., electric motor, hydraulic motor), and the second threaded shaft may be coupled to and driven to rotate by a second motor (e.g., electric motor, hydraulic motor). In operation, rotation of the first and second threaded shafts by the first and second motors causes the first ram and the second ram to move linearly toward and away from one another to adjust the BOP between the open position and the closed position. As discussed in more detail below, in some embodiments, a single motor (e.g., electric motor, hydraulic motor) may rotate both the first and second threaded shafts to cause the first ram and the second ram to move linearly toward and away from one another to adjust the BOP between the open position and the closed position. The disclosed embodiments may provide a compact BOP that is also pressure-balanced to reduce power consumption, for example.

While the disclosed embodiments are described in the context of a drilling system and drilling operations to facilitate discussion, it should be appreciated that the BOP may be adapted for use in other contexts and during other operations. For example, the BOP may be used in a pressure control equipment (PCE) stack that is coupled to and/or positioned vertically above a wellhead during various intervention operations (e.g., inspection or service operations), such as wireline operations in which a tool supported on a wireline is lowered through the PCE stack to enable inspection and/or maintenance of a well. In such cases, the BOP may be adjusted from the open position to the closed position (e.g., to seal about the wireline extending through the PCE stack) to isolate the environment, as well as other surface equipment, from pressurized fluid within the well. In the present disclosure, a conduit may be any of a variety of tubular or cylindrical structures, such as a drill string, wireline, Streamline™, slickline, coiled tubing, or other spoolable rod.

With the foregoing in mind, FIG. 1 is a block diagram of an embodiment of a mineral extraction system 10. The mineral extraction system 10 may be configured to extract various minerals and natural resources, including hydrocarbons (e.g., oil and/or natural gas), from the earth or to inject substances into the earth. The mineral extraction system 10 may be a land-based system (e.g., a surface system) or an offshore system (e.g., an offshore platform system). As shown, a BOP assembly 16 (e.g., BOP stack) is mounted to a wellhead 18, which is coupled to a mineral deposit via a wellbore 26. The wellhead 18 may include any of a variety of other components such as a spool, a hanger, and a "Christmas" tree. The wellhead 18 may return drilling fluid or mud toward the surface 12 during drilling operations, for example. Downhole operations are carried out by a conduit 24 (e.g., drill string) that extends through a central bore 28

(e.g., flow bore) of the BOP assembly 16, through the wellhead 18, and into the wellbore 26.

To facilitate discussion, the BOP assembly 16 and its components may be described with reference to a vertical axis or direction 30, a first horizontal axis or direction 32 (e.g., axial axis or direction), a second horizontal axis or direction 34 (e.g., lateral axis or direction), and a circumferential axis or direction 36 (e.g., about the first horizontal axis 32). The BOP assembly 16 may include one or more BOPs 42 stacked along the vertical axis 30 relative to one another. One or more of the BOPs 42 may include opposed rams that are configured to move along the first horizontal axis 32 toward and away from one another to adjust the BOP 42 between an open position and a closed position. In the open position, the BOP 42 may enable fluid flow through the central bore 28. In the closed position, the BOP 42 may block fluid flow through the central bore 28.

The BOP assembly 16 may include any suitable number of the BOPs 42 (e.g., 1, 2, 3, 4, or more BOPs 42). Additionally, the BOP assembly 16 may include any of a variety of different types of BOPs 42 (e.g., having shear rams, blind rams, blind shear rams, pipe rams). For example, in certain embodiments, the BOP assembly 16 may include one or more BOPs 42 having opposed shear rams or blades configured to sever the conduit 24 to block fluid flow through the central bore 28 and/or one or more BOPs 42 having opposed pipe rams configured to engage the conduit 24 to block fluid flow through the central bore 28 (e.g., through an annulus about the conduit 24). The disclosed embodiments include BOPs 42 having various features, such as threaded openings in the rams and corresponding threaded shafts that rotate within the threaded openings to drive the rams toward and away from one another to adjust the BOP 42 between the open position and the closed position.

Figure 2:
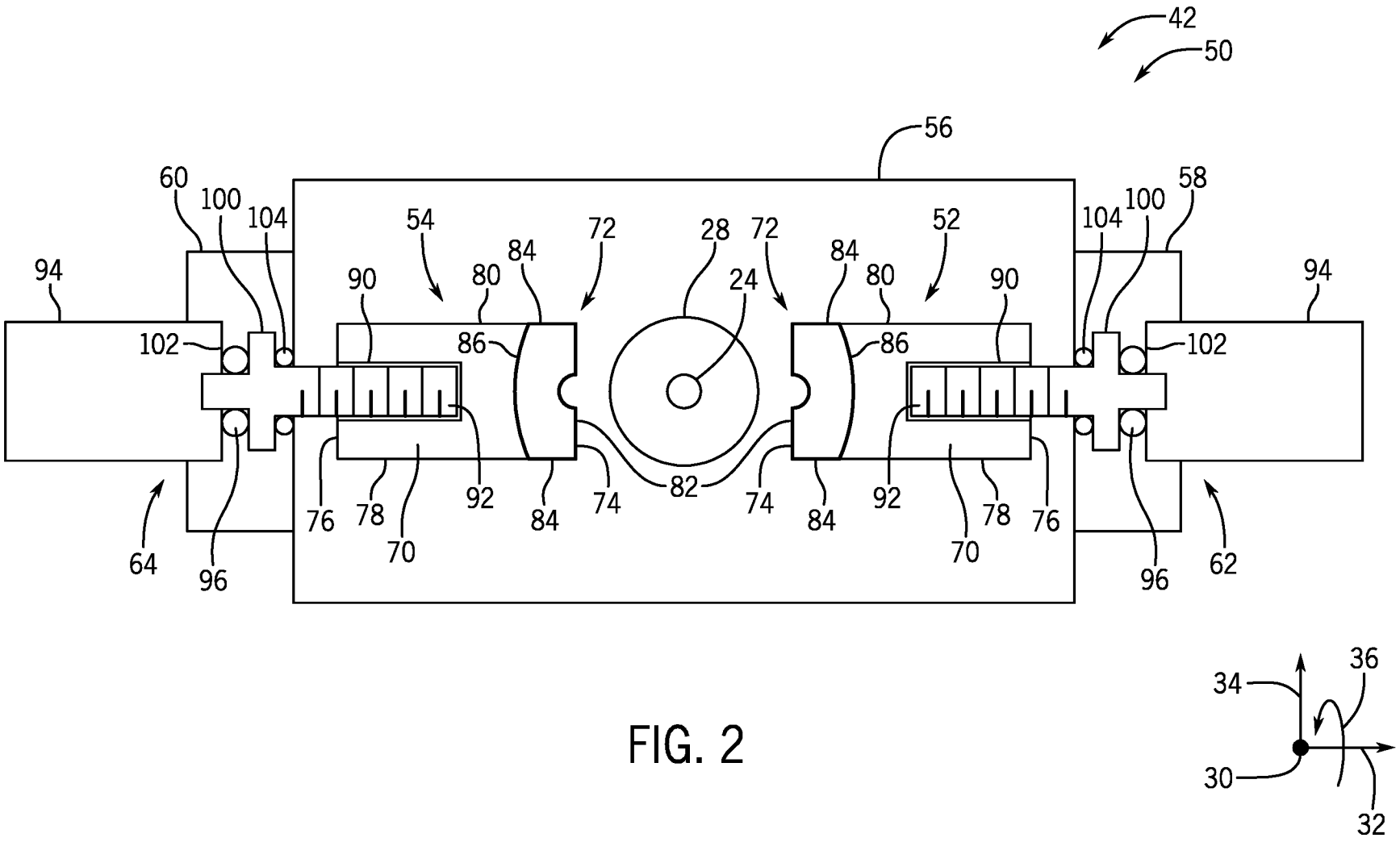
FIG. 2 is a top cross-sectional view of an embodiment of a blowout preventer (BOP) that may be used in the mineral extraction system of FIG. 1, wherein the BOP is in an open position.

FIG. 2 is a top cross-sectional view of an embodiment of one BOP 42 in an open position 50. As noted above, in the open position 50, the BOP 42 may enable fluid flow through the central bore 28 (e.g., through an annulus between the conduit 24 and a wall defining the central bore 28). In the open position 50, a first ram 52 and a second ram 54 are withdrawn into cavities and retracted from the central bore 28, do not contact the conduit 24, and/or do not contact the opposing ram 52, 54.

As shown, the BOP 42 includes a housing 56 (e.g., body). A first bonnet 58 is coupled to a first end of the housing 56 (e.g., via threaded fasteners, such as bolts), and a second bonnet 60 is coupled to a second end of the housing 56 (e.g., via threaded fasteners, such as bolts). The first bonnet 58 supports a first actuator assembly 62, and the second bonnet 60 supports a second actuator assembly 64. As described in more detail below, the first actuator assembly 62 and the second actuator assembly 64 may drive the first ram 52 and the second ram 54, respectively, toward and away from one another along the first horizontal axis 32 to adjust the BOP 42 between the open position 50 and a closed position.

In the illustrated embodiment, the first ram 52 and the second ram 54 each include a respective ram body 70 and a respective packer assembly 72. The first ram 52 and the second ram 54 may each include a forward edge 74 (e.g., sealing edge, conduit-contacting edge), a rearward edge 76 opposite the forward edge 74, a first side edge 78, and a second side edge 80 opposite the first side edge 78. Each packer assembly 72 may include one or more forward packer segments 82 positioned along the forward edge 74 to engage and seal against the conduit 24. The one or more forward packer segments 82 positioned along the forward edge 74 of the first ram 52 may additionally or alternatively seal against the one or more forward packer segments 82 positioned along the forward edge 74 of the second ram 54. Each packer assembly 72 may also include one or more side packer segments 84 positioned along the first side edge 78 and the second side edge 80, as well as one or more top packer segments 86 positioned along an upper surface of the body 70 and extending laterally between the first side edge 78 and the second side edge 80. It should be appreciated that one or more of the segments 82, 84, 86 of the packer assembly 72 may formed as a unitary or one-piece structure, and the packer assembly 72 may have any of a variety of configurations to enable the BOP 42 to form appropriate seals to block fluid flow through the central bore 28 while the BOP 42 is in the closed position.

In the illustrated embodiment, the first ram 52 and the second ram 54 each include an opening 90 (e.g., threaded opening or recess) formed in the rearward edge 76. Each opening 90 is configured to receive a respective shaft 92 (e.g., threaded shaft), which may be driven to rotate by a respective motor 94 (e.g., electric motor, hydraulic motor). The first actuator assembly 62 and the second actuator assembly 64 may each include one shaft 92, one motor 94, as well as a bearing 96.

With reference to the first ram 52 and the first actuator assembly 62, the motor 94 may be controlled (e.g., via an electronic controller) to generate a rotational force that causes rotation of the shaft 92 (e.g., in the circumferential direction 36 or in a direction opposite the circumferential direction 36). The shaft 92 is blocked from moving axially relative to the housing 56 (e.g., via attachment at the motor 94). As a result of this configuration, rotation of the shaft 92 causes the first ram 52 to move linearly along the shaft 92 and along the first horizontal axis 32 between the illustrated open position 50 and the closed position. For example, rotation of the shaft 92 in a first direction (e.g., in the circumferential direction 36) may cause the first ram 52 to move linearly along the first horizontal axis 32 toward the closed position, while rotation of the shaft 92 in a second direction (e.g., a direction opposite the circumferential direction 36) may cause the first ram 52 to move linearly along the first horizontal axis 32 toward the open position 50.

Also with reference to the first ram 52 and the first actuator assembly 62, the shaft 92 is supported by the bearing 96. In operation, pressure from the central bore 28 (e.g., wellbore pressure) may drive the shaft 92 in the first horizontal direction 32 away from the central bore 28. For example, fluid at pressure from the central bore 28 may travel under and/or around the first ram 52 to exert a force on the shaft 92 that drives the shaft 92 in the first horizontal direction 32 away from the central bore 28. However, in the illustrated embodiment, the shaft 92 may be driven against the bearing 96, which is positioned between a flange 100 of the shaft 92 and a support surface 102 (e.g., a surface of a housing of the motor 94 or other axially-facing surface). The bearing 96 absorbs the pressure end load exerted by the pressure on the shaft 92 and facilitates rotation of the shaft 92. As a result of this pressure-balanced configuration, the motor 94 may need to provide less power to drive rotation of the shaft 92 (e.g., as compared to a configuration without the bearing 96), which in turn may facilitate use of an electric motor as the motor 94 and/or enable use of a smaller motor 94. Furthermore, using the electric motor as the motor 94 and controlling the electric motor with an electronic controller may simplify and/or provide for more precise operation of the BOP 42. The illustrated BOP 42 includes a seal 104 (e.g., annular seal) that seals between the first bonnet 58 and the shaft 92.

The second ram 54 and the second actuator assembly 64 may include the same components and same operational features. Additionally, while the illustrated BOP 42 is a pipe ram with pipe rams 52, 54 that are configured to engage the conduit 24, it should be appreciated that the BOP 42 may be another type of ram (e.g., shear ram) and include other types of rams (e.g., shear rams with blades that shear the conduit 24).

Figure 3:
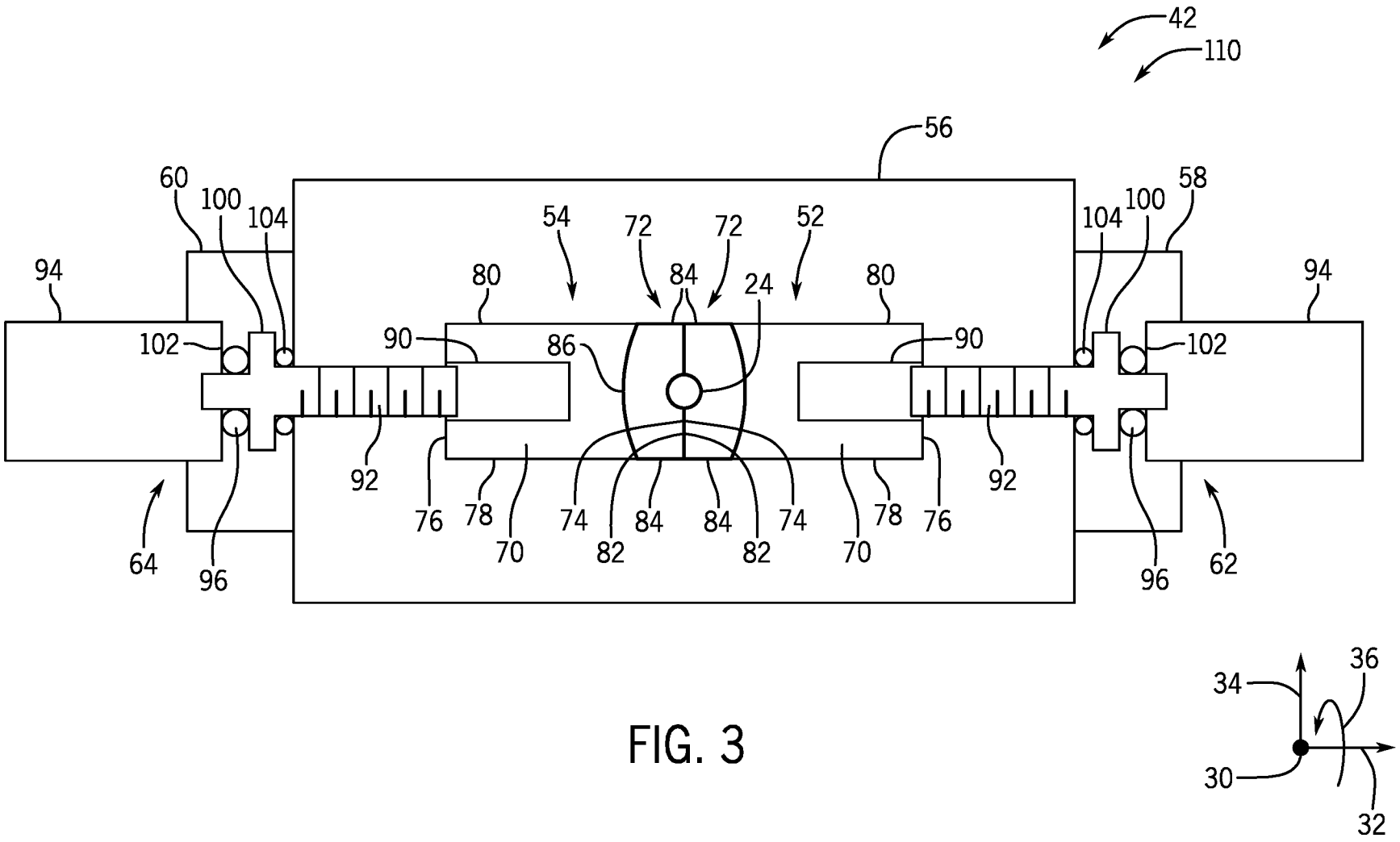
FIG. 3 is a top cross-sectional view of the BOP of FIG. 2 in a closed position.

FIG. 3 is a top cross-sectional view of the BOP 42 in a closed position 110. As noted above, in the closed position 110, the BOP 42 may block fluid flow through the central bore 28 (e.g., through the annulus between the conduit 24 and the wall defining the central bore 28). In the closed position 110, the first ram 52 and the second ram 54 protrude from the cavities and extend into the central bore 28, contact the conduit 24, and/or contact the opposing ram 52, 54.

As discussed above, to adjust the BOP 42 from the open position 50 shown in FIG. 2 to the closed position 110 shown in FIG. 3, each motor 94 may be controlled to generate a rotational force that causes rotation of the respective shaft 92 (e.g., in the circumferential direction 36 or in a direction opposite the circumferential direction 36). Rotation of the shaft 92 of the first actuator assembly 62 causes the first ram 52 to move linearly along the first horizontal axis 32 toward the second ram 54, and rotation of the shaft 92 of the second actuator assembly 64 causes the second ram 54 to move linearly along the first horizontal axis 32 toward the first ram 52. The first ram 52 and the second ram 54 may be driven linearly toward one another until the first ram 52 and the second ram 54 block fluid flow through the central bore 28 (e.g., engage the conduit 24 to block the fluid flow through the annulus about the conduit 24). As shown in FIG. 3, while the BOP 42 is in the closed position 110, the shaft 92 extends into and remains threaded only to an end portion of the opening 90 of the respective ram 52, 54 (e.g., a smaller portion or axial length of the opening 90 than when the BOP 42 is in the open position 50).

Figure 4:
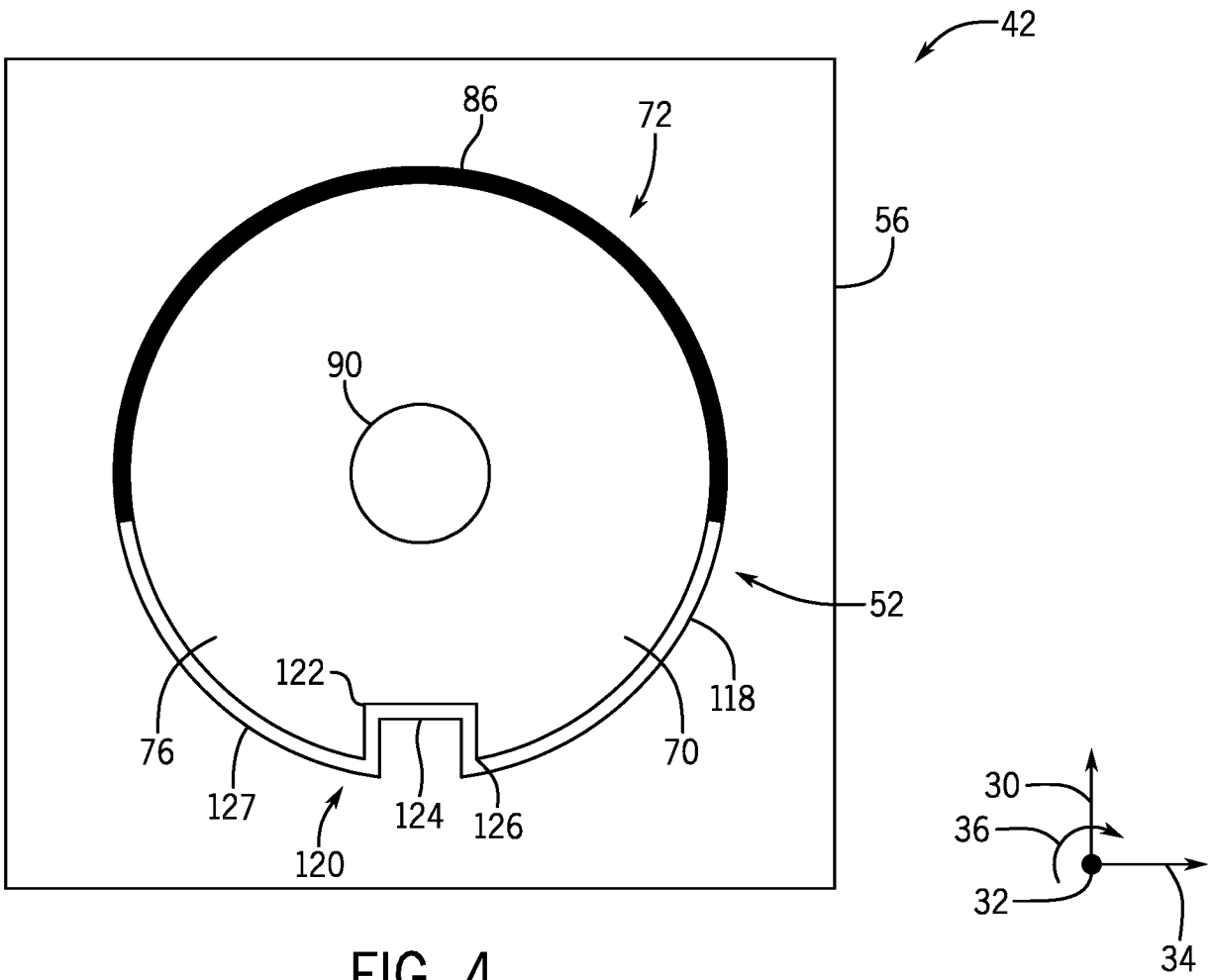
FIG. 4 is an end view of an embodiment of a ram having a generally circular cross-sectional shape that may be used in the BOP of FIGS. 2 and 3.

FIG. 4 is an end view (e.g., of the rearward end 76) of an embodiment of the first ram 52, wherein the first ram 52 is generally cylindrical with a generally circular cross-sectional shape (e.g., taken in a plane perpendicular to the first horizontal axis 32). As shown, the first ram 52 includes the body 70 and the packer assembly 72, which is configured to seal against surfaces of the housing 56 to block fluid flow through the central bore 28 while the BOP 42 is in the closed position 110. The opening 90 is formed in the rearward end 76 of the first ram 52 to receive the shaft 92.

In the illustrated embodiment, an alignment interface 120 (e.g., key-slot interface) is provided between the first ram 52 and the housing 56 to block rotation of the first ram 52 relative to the housing 56. For example, as shown, the first ram 52 includes an alignment slot 122 (e.g., slot) that is configured to receive a protrusion 124 (e.g., key) extending from the housing 56 (e.g., extending radially-inwardly into a ram-supporting cavity 118 defined by the housing 56). As shown, the alignment slot 122 extends about a portion of a circumference of the first ram 52 (e.g., equal to or less than about 25, 20, 15, 10, or 5 percent of the circumference). The alignment slot 122 may extend along the first horizontal axis 32 and may extend along all or some of an axial length of the first ram 52 (e.g., equal to or greater than about 50, 60, 70, 80, or 90 percent of the axial length). Without the alignment interface 120, the first ram 52 may be driven to rotate in response to rotation of the shaft 92 due to the generally circular cross-sectional shape of the first ram 52. In some embodiments, the alignment slot 122 may serve no purpose other than blocking rotation of the first ram 52 relative to the housing 56. While the alignment interface 120 is shown along a lowermost portion 126 of a lower surface 127 that extends laterally between the side edges 78, 80 of the first ram 52 (e.g., opposite the top packer segment 86) in FIG. 4, it should be appreciated that the alignment interface 120 may provided at any location that does not interfere with the seal between the packer assembly 72 and the housing 56 (e.g., at any location along the lower surface 127; a portion of the side edges 78, 80 rearward of the side packer segments 84; an upper surface rearward of the top packer segment 86).

The BOP 42 may include rams 52, 54 having various other cross-sectional shapes (e.g., non-circular). In such cases, the shape of the rams 52, 54 and the corresponding shape of the cavities through which the rams 52, 54 move may block rotation of the rams 52, 54 relative to the housing 56. However, in some embodiments, the alignment interface 120 may be provided for additional stability as the rams 52, 54 move linearly within cavities defined by the housing 56.

Figure 5:
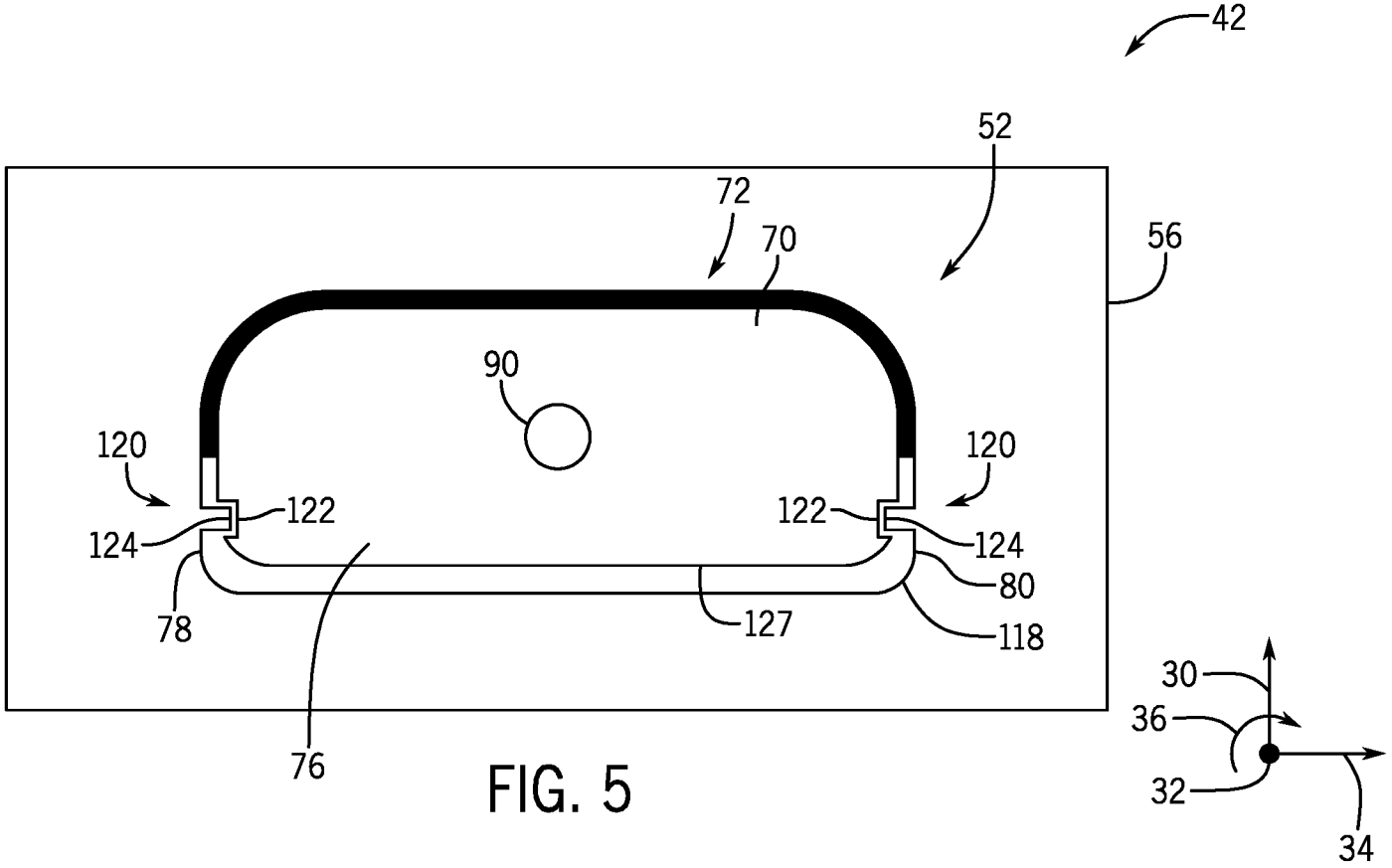
FIG. 5 is an end view of an embodiment of a ram having a generally elliptical cross-sectional shape that may be used in the BOP of FIGS. 2 and 3.

For example, FIG. 5 is an end view (e.g., of the rearward end 76) of an embodiment of the first ram 52, wherein the first ram 52 is generally an elliptic cylinder with a generally oval or elliptical cross-sectional shape (e.g., taken in a plane perpendicular to the first horizontal axis 32). As shown, the first ram 52 includes the body 70 and the packer assembly 72, which is configured to seal against surfaces of the housing 56 to block fluid flow through the central bore 28 while the BOP 42 is in the closed position 110. The opening 90 is formed in the rearward end 76 of the first ram 52 to receive the shaft 92.

In the illustrated embodiment, the alignment interface 120 is provided between the first ram 52 and the housing 56 to block rotation of the first ram 52 relative to the housing 56. For example, as shown, the first ram 52 includes two alignment slots 122 that are configured to receive protrusions 124 extending from the housing 56 (e.g., extending radially-inwardly into the ram-supporting cavity 118 defined by the housing 56). The alignment slots 122 may extend along the first horizontal axis 32 and may extend along all or some of an axial length of the first ram 52 (e.g., equal to or greater than 50, 60, 70, 80, or 90 percent of the axial length).

While the alignment interface 120 includes the alignments slots 122 and the protrusions 124 along the side edges 78, 80 of the first ram 52 in FIG. 5, it should be appreciated that the alignment interface 120 may include alignments slots 122 and the protrusions 124 at any location that does not interfere with the seal between the packer assembly 72 and the housing 56 (e.g., the lower surface 127). Furthermore, with reference to FIGS. 4 and 5, it should also be appreciated that the first ram 52 may include any suitable number of alignment slots 122 (e.g., 1, 2, 3, 4, 5 or more) and the housing 56 may include any suitable number of protrusions 124 (e.g., 1, 2, 3, 4, 5 or more). It should also be appreciated that, in some embodiments, the first ram 52 may include one or more protrusions 124 and the housing 56 may include one or more alignment slots 122. Additionally, the second ram 54 may include similar features to block rotation of the second ram 54 relative to the housing 56.

Figure 6:
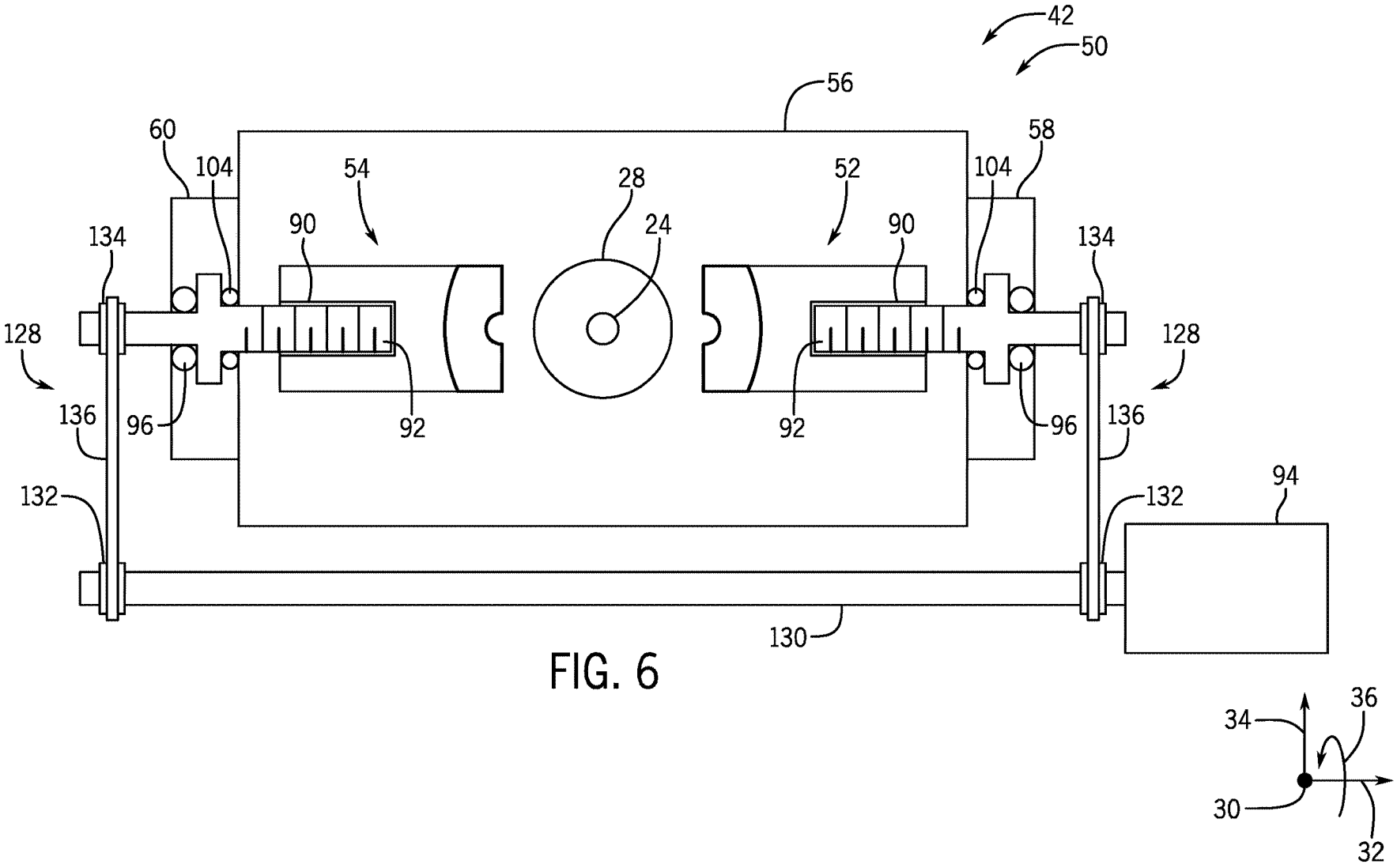
FIG. 6 is a top cross-sectional view of an embodiment of a BOP that may be used in the mineral extraction system of FIG. 1, wherein the BOP includes two rams driven by one motor.

FIG. 6 is a top cross-sectional view of an embodiment of the BOP 42 having two rams 52, 54 driven by one motor 94. The motor 94 may be controlled to generate a rotational force that causes rotation of a drive shaft 130 (e.g., in the circumferential direction 36 or in a direction opposite the circumferential direction 36). Rotation of the drive shaft 130 may cause rotation of the shaft 92 coupled to the first ram 52 and the shaft 92 coupled to the second ram 54 to drive the first ram 52 and the second ram 54 linearly along the first horizontal axis 32.

Various drive mechanisms may be utilized to enable rotation of the drive shaft 130 to drive rotation of the shafts 92. For example, chain drives 128 may be utilized to enable rotation of the drive shaft 130 to drive rotation of the shafts 92. In the illustrated embodiment, gears 132 (e.g., sprocket gears) may be coupled (e.g., non-rotatably coupled) to the drive shaft 130 and gears 134 (e.g., sprocket gears) may be coupled (e.g., non-rotatably coupled) to the shafts 92. Drive chains 136 (e.g., roller chains) may be looped around teeth of the gears 132 and teeth of the gears 134. Thus, rotation of the drive shaft 130 and the attached gears 132 pulls the drive chains 136, which causes the gears 134 and the attached shafts 92 to rotate.

To facilitate moving the first ram 52 and the second ram 54 toward and away from one another, the threads of the shafts 92 may be oriented in opposite directions (e.g., threads of the shaft 92 that is coupled to the first ram 52 are right-handed threads and threads of the shaft 92 that is coupled to the second ram 54 are left-handed threads, or vice versa). As noted above, various drive mechanisms may be utilized to enable rotation of the drive shaft 130 to drive rotation of the shafts 92. For example, bevel gears may be utilized to enable rotation of the drive shaft 130 to drive rotation of the shafts 92. In such cases, the drive chains 136 may be may be replaced with a shaft having bevel gears on both ends (e.g., at the locations of the illustrated gears 132, 134), and these bevel gears may engage corresponding bevel gears on the drive shaft 130 and the shaft 92.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. An assembly for a blowout preventer, comprising:

a ram comprising a threaded opening and defining an alignment interface including an alignment slot configured to receive a protrusion extending from a housing of the blowout preventer;

a threaded shaft configured to engage the threaded opening; and a motor configured to drive rotation of the threaded shaft, wherein rotation of the threaded shaft causes the ram to move axially along the threaded shaft, wherein the alignment interface including the alignment slot is defined by a lower surface of the ram opposite a top packer segment that is configured to create a seal against the housing of the blowout preventer, and wherein the alignment interface is provided at a location that does not interfere with the seal between the top packer segment and the housing of the blowout preventer.

2. The assembly of claim 1, wherein the ram comprises a pipe ram and comprises a packer assembly configured to seal against a conduit, wherein the top packer segment is a component of the packer assembly.

3. The assembly of claim 1, wherein the ram comprises a non-circular cross-sectional shape.

4. The assembly of claim 1, comprising a bearing positioned between a flange of the threaded shaft and a support surface of a bonnet or a motor housing.

5. The assembly of claim 1, comprising:

a second ram comprising a second threaded opening;

a second threaded shaft configured to engage the second threaded opening; and a drive mechanism configured to enable the motor to drive rotation of the threaded shaft and the second threaded shaft.

6. The assembly of claim 5, wherein the drive mechanism comprises a chain drive comprising:

a drive shaft configured to be driven to rotate by the motor;

a first sprocket gear coupled to the drive shaft;

a second sprocket gear coupled to the threaded shaft;

a first chain looped around the first sprocket gear and the second sprocket gear;

a third sprocket gear coupled to the drive shaft;

a fourth sprocket gear coupled to the second threaded shaft; and a second chain looped around the third sprocket gear and the fourth sprocket gear.

7. The assembly of claim 1, wherein the motor comprises an electric motor.

8. A blowout preventer, comprising:

a housing defining a central bore;

a first ram positioned within the housing and comprising a first threaded opening;

a first threaded shaft configured to engage and terminate within the first threaded opening;

a second ram positioned within the housing and comprising a second threaded opening;

a second threaded shaft configured to engage and terminate within the second threaded opening; and at least one motor configured to drive rotation of the first threaded shaft and the second threaded shaft, wherein rotation of the first threaded shaft causes the first ram to move along the first threaded shaft and rotation of the second threaded shaft causes the second ram to move along the first threaded shaft, thereby adjusting the blowout preventer between an open position and a closed position.

9. The blowout preventer of claim 8, wherein the first ram and the second ram comprise pipe rams comprising respective packer assemblies configured to seal against a conduit extending through the central bore.

10. The blowout preventer of claim 8, wherein the first ram and the second ram each comprise a generally circular cross-sectional shape.

11. The blowout preventer of claim 10, wherein the first ram and the second ram each comprise a respective alignment slot configured to receive a respective protrusion extending from the housing.

12. The blowout preventer of claim 8, comprising a first bearing positioned between a first flange of the first threaded shaft and a first support surface and a second bearing positioned between a second flange of the second threaded shaft and a second support surface.

13. The blowout preventer of claim 8, wherein the at least one motor comprises a first motor configured to drive rotation of the first threaded shaft and a second motor configured to drive rotation of the second threaded shaft.

14. The blowout preventer of claim 8, wherein the at least one motor comprises one motor configured to drive rotation of the first threaded shaft and the second threaded shaft via a drive mechanism.

15. The blowout preventer of claim 14, wherein the drive mechanism comprises a chain drive or bezel gears.

16. A blowout preventer, comprising:

a housing comprising a generally cylindrical cavity;

a ram comprising a generally circular cross-sectional shape, wherein the ram is positioned within the generally cylindrical cavity of the housing and the ram comprises a threaded opening;

an alignment interface between the generally cylindrical cavity of the housing and the ram, wherein the alignment interface comprises an alignment slot defined by the ram and a protrusion extending from the housing that engage one another to block rotation of the ram relative to the housing, wherein the alignment interface is defined by a lower surface of the ram opposite a top packer segment that is configured to create a seal against the housing, and wherein the alignment interface is provided at a location that does not interfere with the seal between the top packer segment and the housing;

a threaded shaft configured to engage the threaded opening; and a motor configured to drive rotation of the threaded shaft, wherein rotation of the threaded shaft causes the ram to move axially along the threaded shaft.

17. The blowout preventer of claim 16, wherein the ram comprises a pipe ram and comprises a packer assembly configured to seal against a conduit, and wherein the top packer segment is a component of the packer assembly.

18. The blowout preventer of claim 16, comprising a bearing positioned between a flange of the threaded shaft and a support surface of a bonnet or a motor housing.

* * * * *